US008193891B2

(12) United States Patent
Gerhard et al.

(10) Patent No.: US 8,193,891 B2
(45) Date of Patent: Jun. 5, 2012

(54) HIGH VOLTAGE TRANSFORMER WITH SPACE-SAVING PRIMARY WINDINGS

(75) Inventors: Markus Gerhard, Aachen (DE); Anatoli Saveliev, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 4 days.

(21) Appl. No.: 12/867,890

(22) PCT Filed: Feb. 13, 2009

(86) PCT No.: PCT/IB2009/050590

§ 371 (c)(1), (2), (4) Date: Aug. 17, 2010

(87) PCT Pub. No.: WO2009/104113

PCT Pub. Date: Aug. 27, 2009

(65) Prior Publication Data

US 2011/0037553 A1 Feb. 17, 2011

(30) Foreign Application Priority Data

Feb. 20, 2008 (EP) ..... 08101793

(51) Int. Cl.

| | |
|---|---|
| ***H01F 27/29*** | (2006.01) |
| ***H01F 27/30*** | (2006.01) |
| ***H01F 27/28*** | (2006.01) |
| ***H01F 17/04*** | (2006.01) |

(52) U.S. Cl. ..... 336/192; 336/198; 336/208; 336/220; 336/221; 336/222; 336/182

(58) Field of Classification Search ..... 336/192, 336/182, 183, 186, 185, 198, 205, 208, 220–222
See application file for complete search history.

(56) References Cited

U.S. PATENT DOCUMENTS

| | | | | |
|---|---|---|---|---|
| 3,689,862 | A * | 9/1972 | Hilgers | 336/208 |
| 4,200,853 | A * | 4/1980 | de Jong et al. | 336/192 |
| 4,975,671 | A | 12/1990 | Dirks | |
| 6,507,261 | B1 * | 1/2003 | Haga et al. | 336/198 |
| 6,624,596 | B1 | 9/2003 | Ohsawa et al. | |
| 7,218,199 | B1 * | 5/2007 | Chang | 336/212 |
| 2006/0055340 | A1 | 3/2006 | Birkhardt et al. | |
| 2007/0132535 | A1 | 6/2007 | Kakehashi et al. | |
| 2008/0129205 | A1 * | 6/2008 | Weinert et al. | 315/82 |
| 2008/0211616 | A1 * | 9/2008 | Suzuki et al. | 336/182 |

FOREIGN PATENT DOCUMENTS

| | | | |
|---|---|---|---|
| EP | 0942634 | A2 | 9/1999 |
| WO | 2006054452 | A1 | 5/2006 |
| WO | 2006054454 | A1 | 5/2006 |
| WO | 2006079937 | A1 | 8/2006 |
| WO | 2006119799 | A1 | 11/2006 |
| WO | 2007105339 | A1 | 9/2007 |
| WO | 2008083690 | A1 | 7/2008 |
| WO | WO2008083690 | A1 * | 7/2008 |

* cited by examiner

*Primary Examiner* — Lincoln Donovan
*Assistant Examiner* — Mangtin Lian

(57) ABSTRACT

A high voltage transformer includes an elongate core of a ferromagnetic material. A plastic transformer frame has segment walls arranged perpendicular to the core. A secondary-winding is wound around the core in winding segments divided by the segment walls. A primary winding is formed of conductor segments to provide a loop around the core. At least one of the conductor segments is a connection pin molded in one of the segment walls.

7 Claims, 6 Drawing Sheets

HIGH VOLTAGE TRANSFORMER WITH SPACE-SAVING PRIMARY WINDINGS

FIELD OF THE INVENTION

The invention relates to the field of high-voltage transformers and ignition modules for discharge lamps.

BACKGROUND OF THE INVENTION

Lighting of a discharge lamp requires relatively high voltages of some kV. These high voltages may be generated from a relatively low primary voltage by use of a high-voltage transformer comprising a primary and a secondary winding. The transformer may be part of an electric circuit supplying the primary winding with a relatively low primary voltage for generating the high ignition voltage at the secondary winding.

WO 2006/054454 describes a high-voltage transformer. A bobbin contains primary and secondary windings around a ferrite core. The secondary windings are wound in sections divided by flanges formed on the bobbin. The primary windings are formed by sheet metal conductors formed on a lead frame. The bobbin is made by insertion molding, embedding the primary windings.

SUMMARY OF THE INVENTION

It is an object of the invention to provide a transformer and a discharge lamp ignition module comprising a transformer which satisfies both size restrictions and electrical requirements.

Starting from known concepts of transformers which have primary and secondary windings wound on top of each other, the basic idea of the invention is to use parts of a transformer frame for placing the primary windings, so that more space remains for the secondary winding.

According to the invention, the high-voltage transformer comprises an elongate core made out of a ferromagnetic material, preferably ferrite. A transformer frame made out of a plastic material is provided which comprises segment walls in an orientation substantially perpendicular to the longitudinal direction of the elongate core.

In the spaces provided between the segment walls, the secondary winding is placed in turns around the core. The secondary winding is divided into a plurality of winding segments electrically connected in series. The winding segments are divided by the segment walls.

A primary winding is formed by connected conductor segments. The complete primary winding forms at least one loop around the core. According to the invention, at least one of the conductor segments is a connection pin, molded in one of the segment walls.

The term "connection pin" here refers to a metallic conductor made out of a mechanically stable material, which is suited for electrically conducting the relatively high currents required at the primary side. The connection pin may extend substantially straight, but may also be bent to form part of to the loop formed around the core. Preferably, the connection pin is made from wire, which may have a substantially circular or square cross section, preferably with a width-to-height ratio of no more than 2.

The connection pin is molded in the plastic material of the transformer frame, i.e. it is at least partly embedded so that the plastic material is closed around the pin. Specifically, it is placed within one of the segment walls. Therefore, a substantial amount of space is saved, so that the transformer may be built smaller, or more space may be used for the secondary winding, allowing more turns (to achieve a higher turn rate for a higher secondary voltage) or thicker conductors (to achieve a lower resistance and/or higher secondary side current conduction capability).

Preferably, the primary winding comprises not only one, but several of such connection pins, each placed within the segment walls i.e. between two secondary winding segments. This leads to an overall arrangement with substantially more space to be used for the secondary windings. The connection pins are electrically connected to each other in a way such that a primary winding with at least one turn is formed.

According to a preferred aspect, a discharge lamp ignition module comprises a transformer as described above connected to a lead frame with a plurality of flat conductors arranged in the same plane. A lead frame may advantageously be manufactured out of a flat metal sheet by stamping out desired conductor shapes.

In the discharge lamp ignition module according to the invention, the transformer is both mechanically fixed and electrically connected to conductors of the lead frame by the connection pin. The pin, or a plurality of pins, may be attached to the conductors, e.g. by soldering, conductive gluing or welding. It is especially preferred to use laser welding. The connection pins are thus very efficiently used both as mechanical and electrical connection and as part of the primary winding. Here, the mechanical fastening is especially important during assembly to hold elements of the module together. In a later assembly stage, the whole module may be enclosed e.g. by potting (embedding in a non conductive compound).

According to a further embodiment of the invention, a second lead frame is provided. The transformer is arranged between the two lead frames, which are preferably at least substantially parallel. At least one of the connection pins is attached to the second lead frame. This embodiment ensures a very simple and space-saving arrangement where the transformer is both mechanically and electrically connected to both lead frames.

It is especially preferred that a plurality of connection pins are provided, each molded in the segment walls, and each attached at both ends to conductors of the two lead frames. The flat conductors of the lead frames and the connection pins together then form the primary winding describing at least one turn around a core. The overall shape of the primary winding preferably generally resembles a spiral configuration.

According to a further preferred embodiment, the module comprising the transformer and at least one of the two mentioned lead frames comprises at least one further electrical component to form at least part of a high-voltage generation circuit. The further electrical elements of a preferred circuit of this type are voltage switching elements (i.e. an element automatically switching if a defined threshold voltage is reached), a capacitor (providing the charge for the primary current), and a resistor (e.g. as charge resistor for the capacitor). Further, a diode and an inductance (to be used as a high frequency filter element to provide EMI-compliance) may be provided. One or more of these elements may be directly electrically connected to conductors of one or both of the lead frames, so that they are also mechanically fixed there. Thus, it is possible to provide a very compact, yet electrically fully or at least partly complete circuit for lighting a discharge lamp.

BRIEF DESCRIPTION OF THE DRAWINGS

The above and other objects, features and advantages of the present invention will become apparent from the following description of preferred embodiments, in which.

DETAILED DESCRIPTION OF EMBODIMENTS

Figure 11:
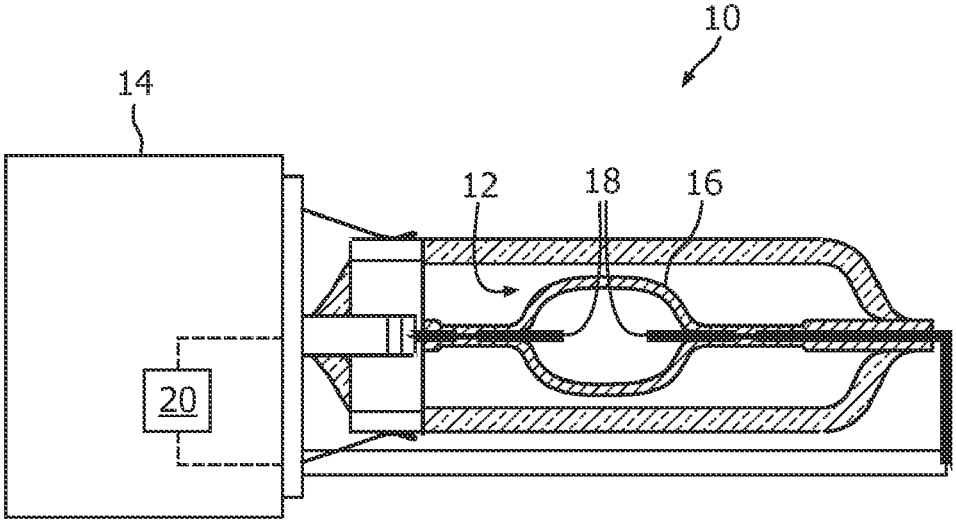
FIG. 11 shows a side view of a discharge lamp including an igniter module.

FIG. 11 shows an example of a high pressure discharge lamp 10 comprising a burner 12 and a base 14. Since discharge lamps are known per se to the skilled person, the following description only gives a short overview of operation and ignition of a lamp of this type. The burner 12 comprises a discharge vessel 16 into which two electrodes 18 project. The discharge vessel comprises a filling with an inert gas, e.g. xenon, and metal halides. In operation of the lamp 10, an arc is generated between the tips of electrodes 18.

While in steady-state operation of the lamp 10 the lamp voltage will typically be in the order of 40 V to 120 V, the voltage required for igniting an arc between an electrode 18 is much higher, e.g. 10-30 kV.

The electrodes 18 are electrically connected to conductors leading to terminals within the base 14. In the shown example, the base 14 comprises an ignition module 20 (shown only symbolically in FIG. 11) that generates a high voltage pulse for igniting the lamp 10.

Figure 10:
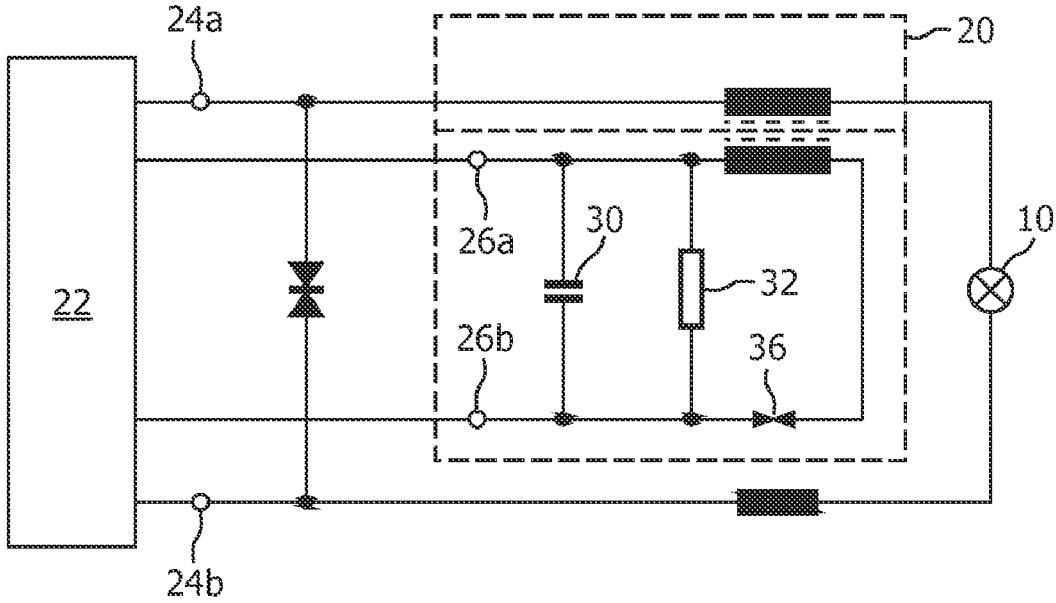
FIG. 10 shows an exemplary circuit diagram of an operating circuit for a discharge lamp.

FIG. 10 shows an example of an electrical circuit for operating the lamp 10. The electrical circuit comprises a ballast 22 supplying an operating voltage to an outer lamp circuit (terminals 24*a*, 24*b*) as well as to the ignition module 20 (terminals 26*a*, 26*b*). The ignition module 20 comprises a capacitor 30 connected to the input terminals 26*a*, 26*b* in parallel to a resistor 32. Further connected in parallel is a series connection of the primary side of a transformer 34 and a switching element 36, which in the shown circuit is a spark gap. The switching element is non-conductive as long as the applied voltage is below a specific breakdown voltage.

A transformer 34 is connected on its secondary side to the outer lamp circuit in series connection with the lamp 10. The transformer 34 serves to convert a relatively low primary side voltage to the high voltage level required for igniting the lamp 10. To achieve this, the capacitor 30 is charged by supplying a corresponding voltage at terminals 26*a*, 26*b*. As soon as the voltage at the capacitor 30 reaches the breakdown voltage level of the switching element 36, the capacitor 30 is discharged over the primary winding of transformer 34. For example, if a spark gap is used as switching element 36 with a breakdown voltage of 800 V, a corresponding voltage pulse is generated at the primary side of transformer 34, leading to a high voltage pulse of e.g. 20 kV in a secondary winding of the transformer 34. The high voltage pulse is supplied to the lamp 10.

The present invention relates to construction of the high voltage transformer 34 and of the ignition module 20, such as the exemplary circuit shown in FIG. 10 Conventional circuit designs are disclosed, e.g., in WO 2006/079937 and U.S. Pat. No. 6,624,596, which are hereby incorporated by reference.

FIGS. 1-6 show in a schematic drawing a first embodiment of a high voltage transformer 34. It should be noted that these figures are intended to show the principal arrangement of elements of the transformer, but are not drawn to scale. As visible from FIG. 6, the transformer 34 comprises a plastic transformer frame 36 provided around a ferrite core 38. The transformer frame 36 comprises section walls 40 separating a plurality of (in the shown example: four) winding sections 42 from each other and end walls 41 provided at the axial ends. The transformer frame is made of an insulating plastic material, preferably polyamide (PA66) and may e.g. be made by injection molding.

Within the winding sections 42, a secondary winding 44 is provided. Within each section 42, the secondary winding 44 is provided as multiple turns of an insulated wire. The windings of axially adjacent sections 42 are connected in series. Separation of the secondary windings 44 in sections 42 helps to achieve good isolation and reduce parasitic capacitances.

The transformer 34 is part of the ignition module 20 which may be integrated in the lamp base 14. Therefore, the transformer must fulfill strict size requirements.

As an example, the transformer shown in FIGS. 1-6 has a total length of 30 mm. Each section 42 has a width of approximately 5 mm. The secondary winding 44 is wound from a wire of 0.4 mm diameter to form a 12 mm diameter coil around the ferrite core (core diameter 5 mm).

The transformer 34 is connected on one side to a lead frame 46. The lead frame 46 is comprised of flat conductive tracks 48 (visible in FIG. 1). The conductive tracks 48 are during production stamped out of a thin metal sheet, preferably copper. They serve as conductors connecting connection terminals of electrical elements. While in principle comparable to conductive tracks of a conventional PCB (printed circuit board), the conductive tracks 48 of the leadframe 46 are, at least during assembly, not bound to a carrier substrate.

The transformer frame 36 is mechanically fixed to the lead frame 46 by means of connections pins 50. A plurality of connection pins 50 are provided in parallel orientation, fixed on one end to the conductive tracks 48 of the leadframe 46, which may be effected by soldering or conductive gluing but is preferably achieved by laser welding. The connection pins 50 are made of a mechanically stable electrically conductive material, preferably metal. In the shown example, the connection pins 50 are made of a copper wire of 0.6 mm diameter. The wire is preferably of circular or square cross section, but could alternatively also be of generally rectangular cross-sectional shape.

The central part of the connection pins 50 is embedded within the plastic material of the transformer frame 36. The connection pins are here located within the section walls 40 and in one of the end walls 41. Thus, the connection pins 50 serve to firmly fix, at least during assembly, the elements 48 of leadframe 46 to the transformer frame 36.

On the other hand, the connection pins 50 also serve as conductors. In the shown example, the secondary winding is connected to a connection pin 50 embedded in one of the end walls 41 by a wire end 43. The secondary winding is thus electrically connected to the leadframe. The connection pins 50 embedded in the section walls 40 are used to form a primary winding of the transformer 34. As shown e.g. in FIG. 3 the opposite ends of the connection pins 50 are connected at the transformer side opposite to the leadframe 46 by wire connections 52. Together with the diagonally arranged conductive tracks 48 of the leadframe 46 (FIG. 1), the wire connections 52 and the connection pins 50 form a primary winding of generally spiral shape. Each pair of connection pins 50 embedded in the same section wall 40 on opposite sides of the core 38 is connected once straight (i.e. perpendicular to the longitudinal direction of the core 38) to the other connection pin 50, and once diagonally to the connection pin 50 of an axially adjacent section wall 40.

It is of course understandable for the skilled person that instead of, as shown in the example, providing diagonal conductive track 48 at the leadframe 46 and straight wire connections 52 on the opposite side, a spiral configuration could also be achieved by diagonal wire connections and straight leadframe tracks (not shown).

The transformer 34 thus has both a secondary winding (wound in sections 42) and a primary winding (consisting of the conductive tracks 48, connection pins 50 and wire connections 52) wound in roughly spiral configuration around the core 38. The primary winding has only a very limited number of loops (three in the shown example). Due to the relatively thick connectors used, the primary winding can sustain relatively high currents. On the other hand, the secondary winding comprises a high number of loops to achieve the necessary turn rate of e.g. 50-100 to transform the 800 V primary voltage into a desired secondary voltage of 20 kV.

Figure 1:
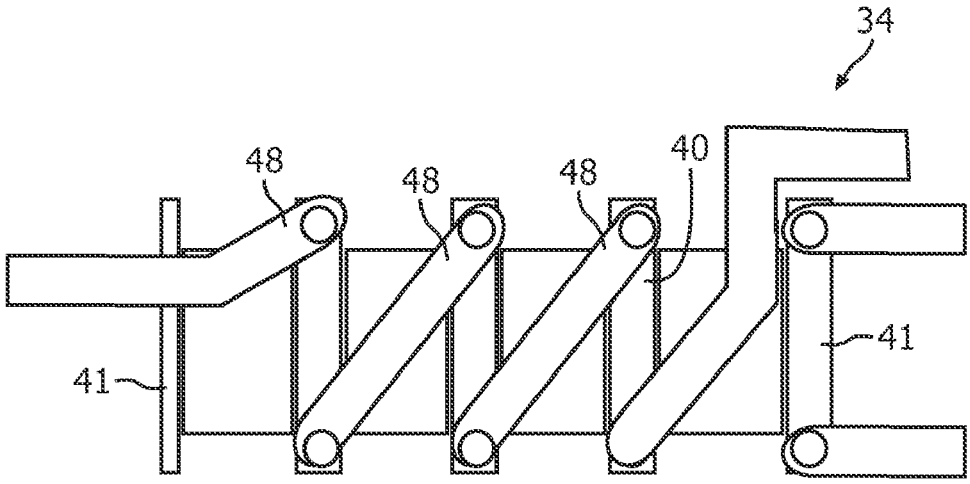
FIG. 1 shows a top view of a first embodiment of a high voltage transformer.
Figure 2:
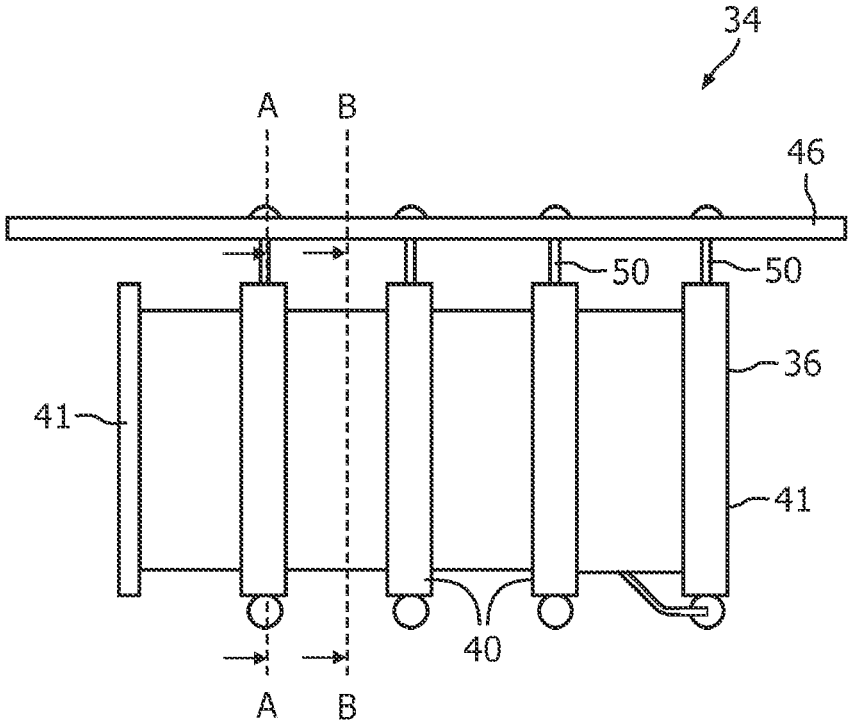
FIG. 2 shows a side view of the transformer of FIG. 1.
Figure 3:
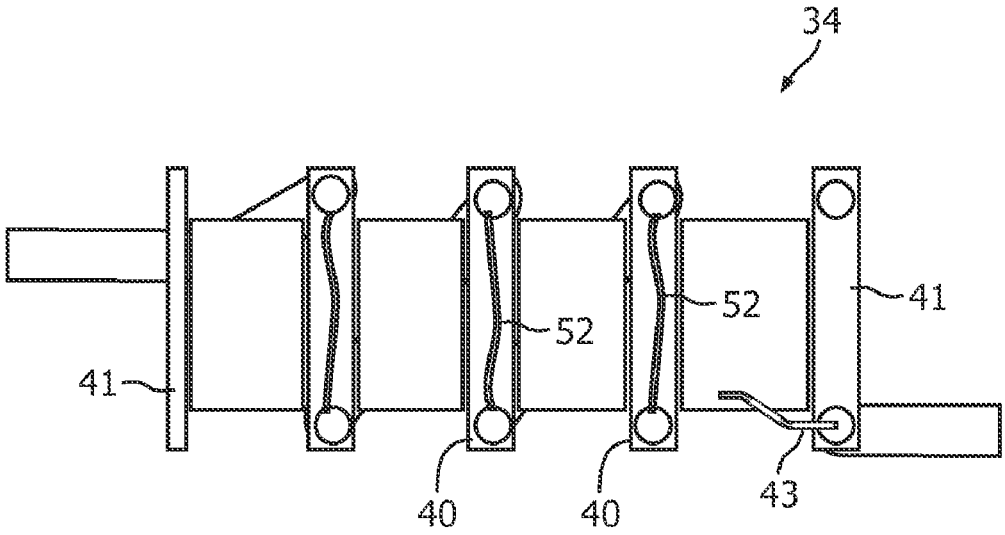
FIG. 3 shows a bottom view of the transformer of FIG. 1, FIG. 2.
Figure 4:
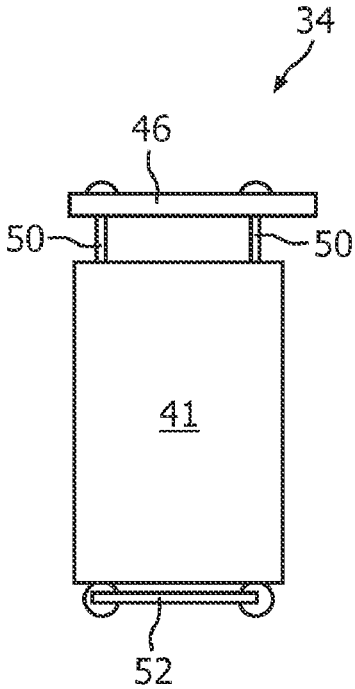
FIG. 4 shows a front view of the transformer of FIG. 1-3.
Figure 5A:
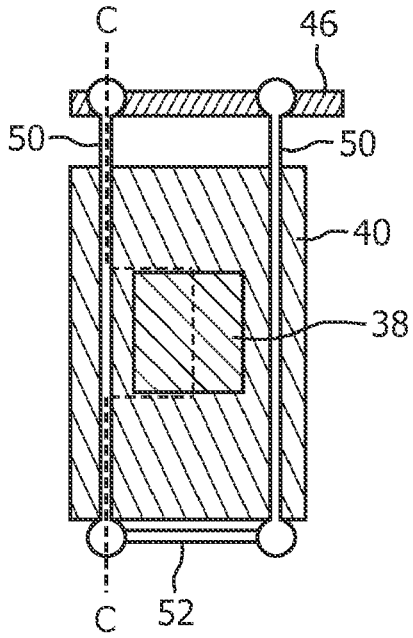
FIG. 5*a* shows a sectional view of the transformer of FIG. 2 taken along the line A . . . A.
Figure 5B:
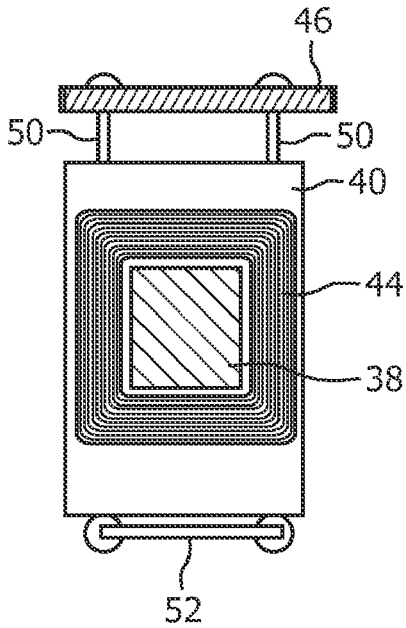
FIG. 5*b* shows a sectional view of the transformer shown in FIG. 2 taken along the line B . . . B.
Figure 6:
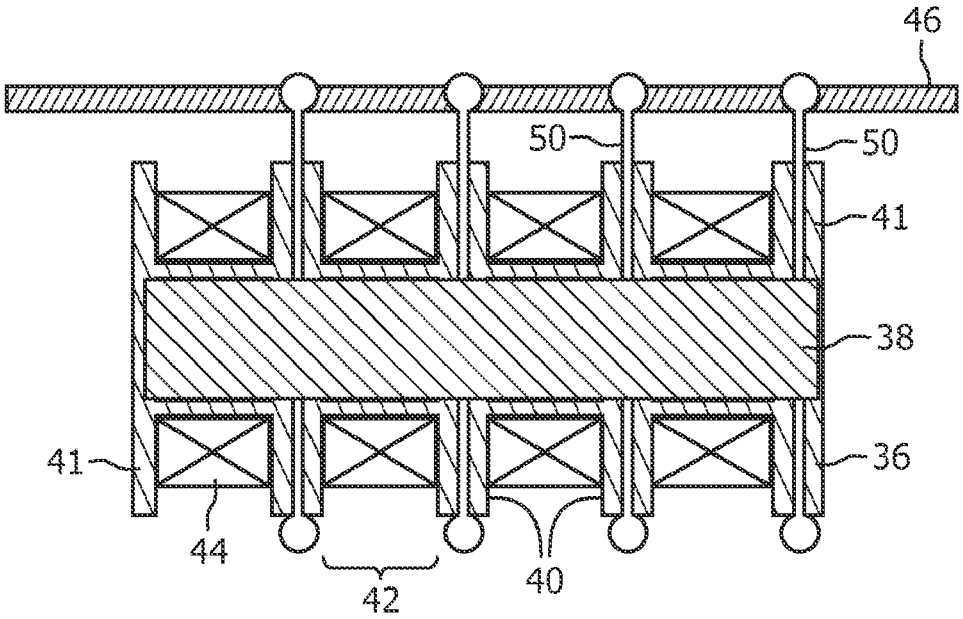
FIG. 6 shows a sectional side view of the transformer of FIG. 5*a* taken along the line C . . . C.
Figure 7:
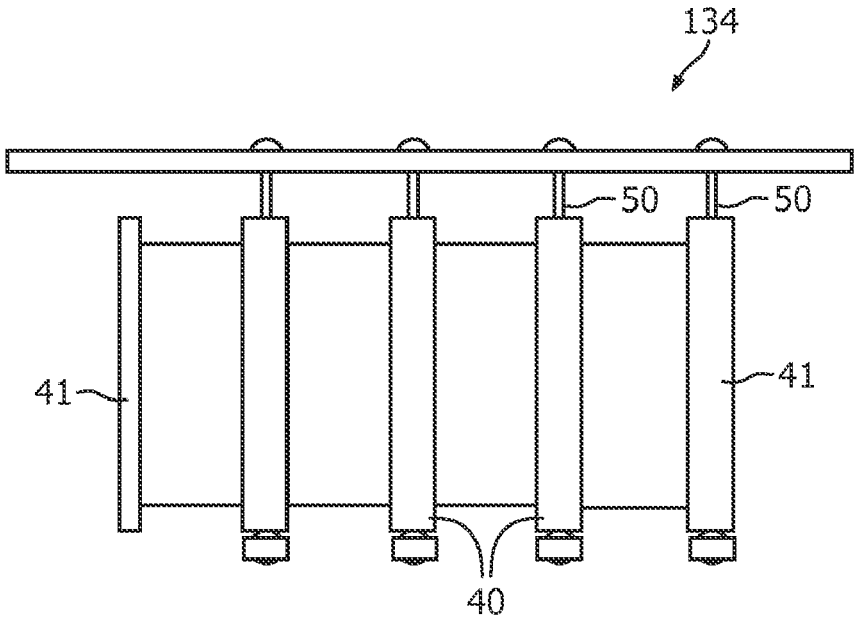
FIG. 7 shows a side view of a second embodiment of a transformer.
Figure 8:
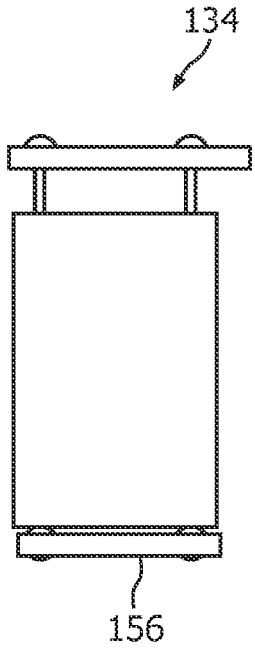
FIG. 8 shows a front view of the transformer of FIG. 7.
Figure 9:
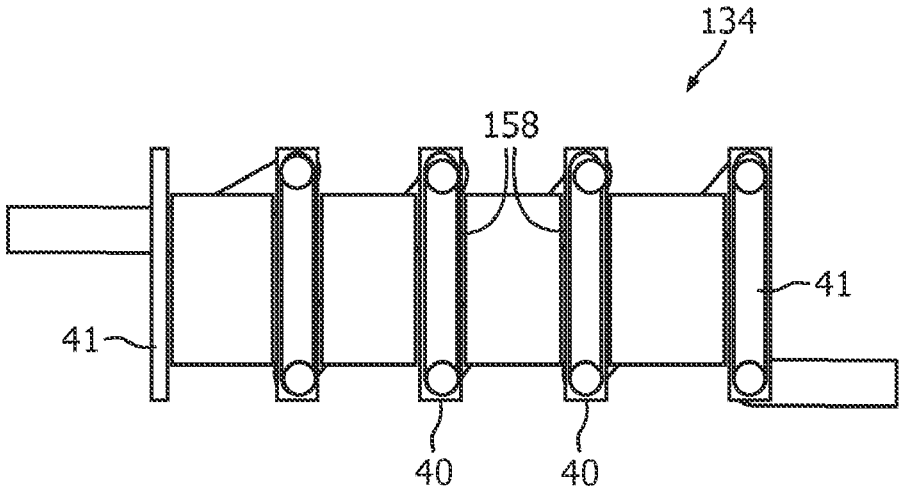
FIG. 9 shows a bottom view of the transformer of FIG. 7, FIG. 8.

FIGS. 7-9 show an alternative embodiment of a transformer 134. The transformer 134 according to the second embodiment in large parts corresponds to the transformer 34 of the first embodiment. Like parts are referenced by like numerals. In the following, only the differences between the embodiments will be further described.

In contrast to the first embodiment, the connections between the opposite ends of the connection pins 50 in the second embodiment are made by a second leadframe 156. The second leadframe 156 comprises conductive segments 158 which replace the wire connections 52 of the first embodiment. Again, to achieve a generally spiral configuration of the primary winding, diagonal tracks may be provided either at the first leadframe 46 or at the second leadframe 156 while straight interconnections may then be provided at the opposite side. Since leadframes are well suited for mass production, the preferred second embodiment offers advantages of cost effective production.

Figure 12:
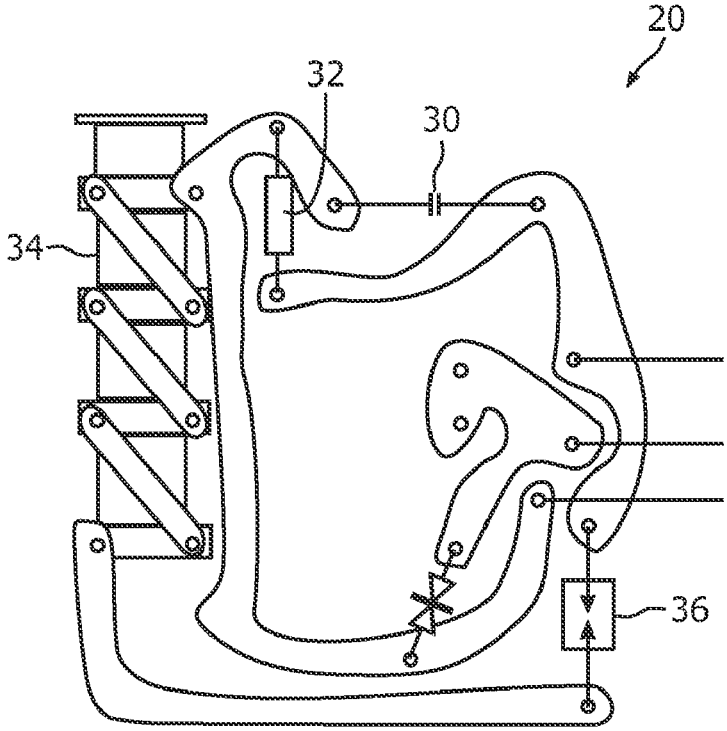
FIG. 12 shows a bottom view of an igniter module including the transformer of FIG. 7-9

While the transformer 34 according the embodiments described above may be used as a standalone electrical component, e.g. of an ignition circuit described above, it is preferably part of an ignition module 20. The ignition module 20 comprises further electrical elements, namely capacitor 30, resistor 32 and switching element 36. Some or even all of these further electrical elements may be fixed to one or both of the lead frames 46, 156 to form an ignition module 20 as shown in FIG. 12, where all electrical elements are both electrically connected to form the desired circuit (e.g. FIG. 10, or a different circuit of WO 2006/079937) and firmly mechanically interconnected. The central portion of module 20 has no electrical components to leave space for the burner of the lamp 10.

The whole module is preferably potted, i.e. embedded within a potting compound, e.g. epoxy resin or silicone to fix the elements in a mechanically stable way suited e.g. for automotive applications and to further provide electrical insulation suitable for the high ignition voltages.

The invention has been illustrated and described in detail in the drawings and foregoing description. Such illustration and description are to be considered illustrative or exemplary and not restrictive; the invention is not limited to the disclosed embodiments.

In the claims, the word "comprising" does not exclude other elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A high voltage transformer comprising
an elongate core comprising a ferromagnetic material;
a lead frame comprising a plurality of flat conductors;
a transformer frame comprising a plastic material, said transformer frame comprising a plurality of segment walls arranged perpendicular to a longitudinal direction of said core;
a secondary winding comprising a conductor wound around said core, said secondary winding comprising a plurality of winding segments divided by said segment walls;
a primary winding comprising conductor segments connected to form at least one turn around said core, wherein at least one of said conductor segments is a connection pin molded in one of said segment walls; and
wherein said connection pin is attached to said lead frame to mechanically fix said lead frame to said transformer.

2. The high voltage transformer according to claim 1, wherein said conductor segments comprise a plurality of connection pins each of said connection pins molded in one of said segment walls, and wherein said connection pins are connected to each other such that primary winding with at least one turn around said core is formed.

3. The high voltage transformer according to claim 1, wherein said connection pins have a substantially circular or square cross-sectional shape.

4. A discharge lamp ignition module comprising:
a transformer; and
a first lead frame comprising a plurality of flat conductors in a same plane,
wherein the transformer comprises:
an elongate core comprising a ferromagnetic material;
a transformer frame comprising a plastic material, said transformer frame comprising a plurality of segment walls arranged perpendicular to a longitudinal direction of said core;
a secondary winding comprising a conductor wound around said core, said secondary winding comprising a plurality of winding segments divided by said segment walls; and
a primary winding comprising conductor segments connected to form at least one turn around said core, wherein at least one of said conductor segments is a connection pin molded in one of said segment walls,
wherein said connection pin is attached to said first lead frame to mechanically fix said first lead frame to said transformer.

5. The discharge lamp ignition module according to claim 4, said module further comprising
a second lead frame comprising a plurality of flat conductors in the same plane,
wherein said transformer is arranged between said first and second lead frames, and wherein at least one of said connection pins is attached to said second lead frame.

6. The discharge lamp ignition module according to claim 5, wherein a plurality of connection pins are provided which are each molded in said segment walls, wherein said connection pins are attached at both ends thereof to flat conductors of said first and second lead frame and wherein said conductors connect said connection pins such that a primary winding with at least one turn around said core is formed.

7. The discharge lamp ignition module according to claim 4, wherein at least one further electrical element is electrically connected and mechanically fixed to said lead frame, and wherein said further electrical element is at least one of: a voltage switching element, a resistor or a capacitor.

* * * * *